US006795085B1

(12) United States Patent
Doherty et al.

(10) Patent No.: US 6,795,085 B1
(45) Date of Patent: Sep. 21, 2004

(54) CONTOURING REDUCTION IN SLM-BASED DISPLAY

(75) Inventors: Donald B. Doherty, Richardson, TX (US); Gregory S. Pettitt, Rowlett, TX (US); Vishal Markandey, Dallas, TX (US); Daniel J. Morgan, Denton, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1132 days.

(21) Appl. No.: 09/038,219

(22) Filed: Mar. 11, 1998

Related U.S. Application Data

(60) Provisional application No. 60/036,301, filed on Mar. 14, 1997.

(51) Int. Cl.[7] ..... G09G 5/02

(52) U.S. Cl. ..... 345/596; 382/167; 345/89

(58) Field of Search ..... 382/167; 315/383; 348/742; 345/89, 596

(56) References Cited

U.S. PATENT DOCUMENTS 4,652,832 A * 3/1987 Jasper ..... 327/106
4,779,083 A * 10/1988 Ishii et al. ..... 345/148
4,924,413 A * 5/1990 Suwannukul ..... 345/187
4,965,668 A * 10/1990 Abt et al. ..... 345/187
5,012,163 A * 4/1991 Alcorn et al. ..... 315/383
5,179,641 A * 1/1993 Comins et al. ..... 345/432
5,479,549 A * 12/1995 Lum ..... 395/143
5,479,594 A * 12/1995 Lum ..... 345/443
5,495,346 A * 2/1996 Choi et al. ..... 358/457
5,530,561 A * 6/1996 Shimazaki ..... 358/455
5,539,667 A * 7/1996 Rode ..... 386/40
5,696,710 A * 12/1997 Hague et al. ..... 708/551
5,777,624 A * 7/1998 Munson ..... 345/431
5,822,021 A * 10/1998 Johnson et al. ..... 348/742
5,923,316 A * 7/1999 Kitamura et al. ..... 345/154

* cited by examiner

*Primary Examiner*—Chanh Nguyen
*Assistant Examiner*—Fritz Alphonse
(74) *Attorney, Agent, or Firm*—Charles A. Bill; Wade James Brady, III; Frederick J. Telecky, Jr.

(57) ABSTRACT

Methods of reducing contouring in images display by a linear display device, such as a spatial light modulator. The methods operate on a high resolution signal, which represents a stream of pixel values. The per pixel resolution of this signal is greater than the per pixel display resolution, and its less significant bits are treated as an error component. Random values are added to the error component either in conjunction with error diffusion values (FIG. 1) or to provide a dither that is directly proportional to the error (FIG. 4), or to provide a dither that has both spatial and temporal contributions (FIG. 5).

8 Claims, 2 Drawing Sheets

CONTOURING REDUCTION IN SLM-BASED DISPLAY

This application claims priority under 35 U.S.C. § 119 (e)(1) of provisional application No. 60/036,301 filed Mar. 14, 1997.

TECHNICAL FIELD OF THE INVENTION

The present invention relates generally to digital display systems, and more particularly to a method of reducing contouring artifacts in display systems that use a spatial light modulator display device.

BACKGROUND OF THE INVENTION

One goal of a display system is to present the displayed image in a manner that reduces contouring artifacts. If a given number of intensity levels is evenly distributed from maximum to minimum intensity, the human eye will be more sensitive to intensity transitions at the lower levels The eye can perceive approximately a 2% change in luminance. If the signal driving the display device has sufficiently high resolution per pixel, the changes will be less than 2%. However, if it does not have sufficiently high resolution, the changes will be greater than 2% at lower levels and will result in a visual artifact known as contouring.

Some display systems use non-linear display devices, such as cathode ray tubes. In these systems, contouring is reduced by the non-linear nature of the display in combination with a gamma correction imposed on the analog signal that drives the display.

Display systems that use a linear display device, such as a spatial light modulator (SLM), drive the SLM with a digital signal having a given resolution per pixel. This display resolution is constrained by the bandwidth limitations of the SLM. For example, a typical SLM might be driven with a 8-bit per pixel signal. However, this display resolution is insufficient to avoid contouring. Because the SLM is a linear device it does not benefit from the gamma correction of non-linear devices, and in fact, the gamma correction is reversed prior to display.

In the case of SLMs, various digital processing techniques have been devised to reduce contouring without increasing the display resolution. One such method is to use an error diffusion circuit. The error diffusion circuit operates on a high resolution degamma signal, that is, a signal from which gamma correction previously imposed on the signal is all or partly reversed. The degamma process provides a signal having higher resolution than the display resolution. The less significant bits are considered "error" bits. For each pixel value, the circuit divides the error into components and distributes the components to neighboring pixels. However, the distribution of the error components to vertically neighboring pixels requires the use of line memories, which adds to the cost of the system.

SUMMARY OF THE INVENTION

One aspect of the invention is an error diffusion method of reducing contouring. This method is used for a display system having a linear display device, such as a spatial light modulator (SLM), with the SLM having a given per-pixel resolution (display resolution). The method operates on a high resolution signal, which carries the stream of pixel values of the image to be generated. The high resolution signal has an error component and a non-error (display resolution) component. The error component is comprised of the less significant bits of each pixel value, that is, the bits that are not part of the display resolution. For each pixel value, the error component of the previously processed pixel value is fed back and added to a random value. The sum is added to the high resolution value, and the resulting value is truncated to the display resolution. The truncated values comprise the signal that drives the SLM.

Other aspects of the invention are dithering methods of reducing contouring. Like the error diffusion method described in the preceding paragraph, the dithering methods operate on a high resolution signal that has an error component. One or more dither signals are added to the high resolution signal, and no feedback is used. In one embodiment, the dither signal is a stream of random values. When added to the pixel values of the high resolution signal, the random values from the random signal cause the non-error component of each pixel value to either shift up one bit, or to not shift up. The average frequency of this shifting is proportional to the error. In another embodiment, which reduces patterns that might appear as a result of the random value dither, the random value signal is added to a spatial-temporal dither signal and the sum is added to the high resolution signal. In both cases, the signal is truncated to provide the drive signal for the SLM.

An advantage of the invention is that contouring is reduced without increasing bandwidth demands on the SLM. The error diffusion method eliminates the line memory that was required in prior error diffusion circuitry. The result is a reduction in cost of the display system. The dithering methods further reduce costs because the dither circuitry has less logic circuitry than error diffusion circuitry.

DETAILED DESCRIPTION OF THE INVENTION

The invention described herein is directed to various methods of reducing contouring in a displayed image. The methods are designed for use with a display system that uses a linear display device. Each method operates on pixel values represented by a high resolution pixel value signal. The resolution of this high resolution signal is greater than the display resolution of the display device, such that the less significant bits can be considered to be an error component. As explained below, one method is an "error diffusion" method, in the sense that error components are fed back and used to generate each new pixel value. This feedback, together with a random noise value, are used to generate each next pixel. Another method is a dithering method, which uses a random noise value added to the error component. A third method is also a dithering method, which uses a random noise value and an additional dither value to the error component. In each case, the error component provides a bias and the random value results in the non-error component of the signal either being shifted or not shifted up to the next higher value.

The display system with which the invention is used may be any type of digital display system using a display device having a linear response. Examples of linear display devices are spatial light modulators (SLM), such as digital micro-mechanical devices (DMDs) and liquid crystal displays (LCDs). Various display systems, each of which uses one or more DMDs, are described in U.S. Pat. No. 5,079,544, entitled "Standard Independent Digitized Video System," and in U.S. Pat. No. 5,526,051, entitled "Digital Television System," and in U.S. patent application Ser. No. 08/146,385, entitled "DMD Display System." These systems are specifically designed for a DMD (digital micro-mirror device), which is a type of SLM. Each of these patents and patent applications is assigned to Texas Instruments Incorporated, and each is incorporated by reference herein.

Figure 1:
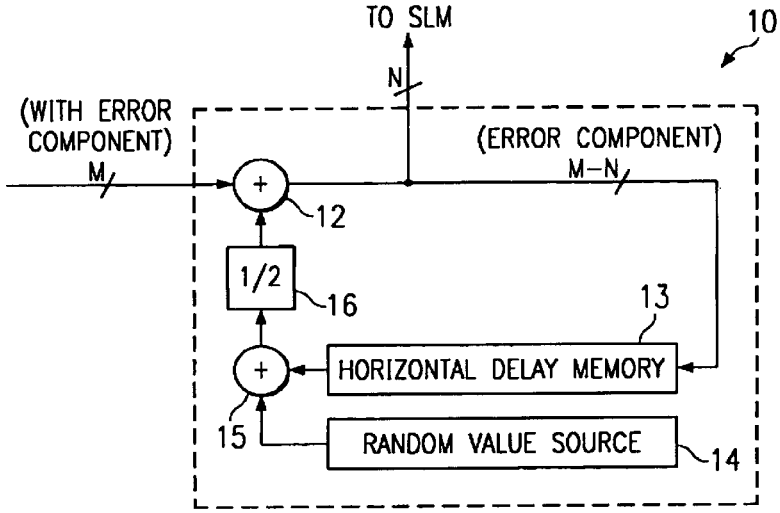
FIG. 1 illustrates an error diffusion unit in accordance with the invention.

FIG. 1 illustrates an error diffusion unit 10 in accordance with the invention. Circuit 10 is part of an SLM-based display system and is in the image data path prior to delivery of the image data to the frame buffer, which delivers the data to the SLM. As explained below, error diffusion unit 10 does not use a vertical error signal as does a conventional error diffusion unit. Instead, the vertical error signal has been replaced with a random noise signal. As a result, for each pixel value, its error component is derived from a horizontal error value from the previous pixel and a random noise value.

The input signal to error diffusion unit 10 is an M-bit "high resolution" signal, which represents the stream of pixel values that will be used to generate the image. The M-bit resolution is greater than that of the N-bit signal that drives the SLM display. The difference between the two resolutions, that is, the M−N portion of the signal, is referred to herein as an error component.

In the example of this description, the M-bit signal is the output of a degamma process, which undoes a gamma correction imposed on the signal prior to transmission in anticipation of non-linear display device such as a CRT. A degamma process used in an SLM-based display system is described in U.S. Pat. No. 5,526,051, referenced above assigned to Texas Instruments Incorporated. It is possible that a high resolution signal having an error component could be generated by means other than a degamma process, with the significant characteristic being that the M-bit signal is a stream of pixel values that are to be truncated (or divided) for display and therefore have a higher per pixel resolution than the displayed pixel values.

The M-bit signal is fed to a summing device 12. For each M-bit pixel value, summing device 12 also receives an error value, which is derived from an error value of a previous pixel in the same line (the error component from the current pixel's horizontal neighbor) and a random value. These two values are obtained from a horizontal delay memory 13 and a random noise source 14, respectively. The two values are summed with a summing device 15 and divided by 2 with a dividing device 16 before being delivered to summing device 12. The division by 2 retains the same number of bits as the error component. As an alternative to dividing device 16, modulo addition could be used.

The output of the summing device 12 is an M-bit signal. This signal is then divided such that the N most significant bits are delivered to the SLM. The remaining bits (M−N bits) are delivered to the horizontal delay memory 13 to be used to generate the next pixel value.

As a result of the above-described process, for each pixel value represented by the M-bit signal, an error component may or may not affect the N-bit component by carrying a bit into the N-bit component. After the error component serves its purpose of either shifting or not shifting the N-bit component, the error component is truncated from the M-bit signal. The resulting N-bit signal has the proper resolution for delivery to the SLM.

The random value source 14 can be implemented with various known random number generating devices. One such device is a linear feedback shift register.

Figure 2:
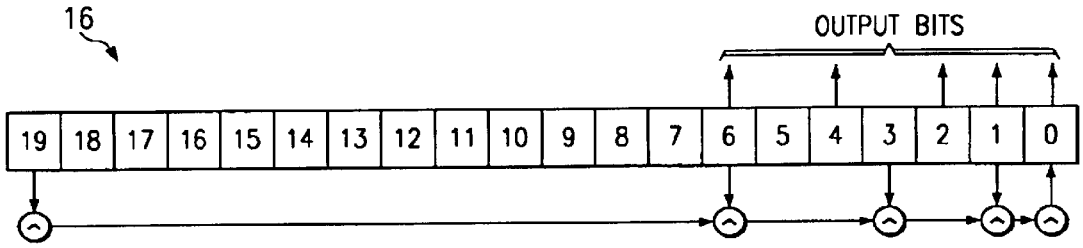
FIG. 2 illustrates an example of an implementation of the random signal source of FIG. 1.

FIG. 2 illustrates the random value source 14 of FIG. 1, implemented as a linear feedback shift register. The shift register has some of its bits XOR'd together to form the input of the shift register. In the example of FIGURE, the shift register is a 20-bit shift register with bits 19, 6, 3, 1, and 0 XOR'd together. An output word is formed using the output of selected bits from the register. In the example of FIG. 2, a 5-bit output word is formed using bits 6,4,2,1, and 0.

The shift register of FIG. 2 may be re-seeded on each field. This reduces noise in the image, but may result in a spatially fixed random pattern. As explained below in connection with FIG. 5, a temporal dither may be introduced into the M-bit signal to avoid this effect.

An alternative solution to the contouring problem is digital signal dithering, as an alternative to error diffusion. As explained below, a low-level noise signal is added to the video signal. The new signal is then truncated to the N-bit signal that drives the SLM display.

Figure 3:
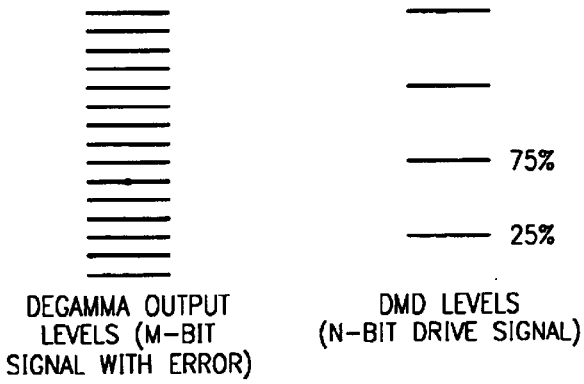
FIG. 3 illustrates the principle of dithering in accordance with the invention, that is, the addition of a random value to an error component of a high resolution pixel value signal.

FIG. 3 illustrates the principal of digital signal dithering in accordance with the invention. The horizontal lines on the left half of FIG. 3 represent levels of an M-bit pixel value signal. For purposes of example, this resolution might be 10 bits. The horizontal lines on the right half of FIG. 3 represent the levels of the lower resolution N-bit signal that drives the SLM device. For example, this resolution might be 8 bits.

The circle represents a desired signal value, which can be represented by an M-bit value but not by an N-bit value. In the example of FIG. 3, the desired signal value is ¾ from the next lower level to the next higher level of the SLM drive signal. In other words, the error is 0.75.

The digital dither, applied as uniform random noise, shifts the M-bit signal back and forth between the DMD drive signal's intensity levels. Each pixel value will have its N-bit component shifted up one level or not shifted, depending on the random value. On average, the frequency of the shifting is proportional to the error in the desired signal level. In the example of FIG. 3, the resultant DMD drive signal is at the higher quantization level 75% of the time and at the lower quantization level 25% of the time.

Figure 4:
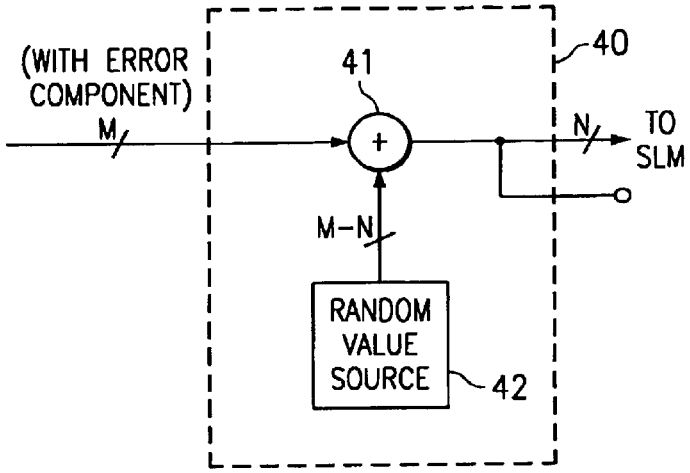
FIG. 4 illustrates a dithering unit in accordance with the invention.

FIG. 4 illustrates a digital dithering unit 40 in accordance with the invention. The M-bit high resolution signal is fed to a summing device 41, where a random noise signal is added to the M-bit signal. The output is truncated to an N-bit signal for display.

The random noise signal is generated with a uniform random number source 42. The linear feedback shift register described above in connection with FIG. 2 may be used to implement the random number source 42. Other random value generating devices could be used.

Because of the bias provided by the error component of the M-bit signal, the random value results in the next higher level at a frequency directly related to the bias. Thus, referring again to the example of FIG. 3, an error component that is 0.75 to the next level of the N-bit (non-error) component of the M-bit signal provides a bias that results in the N-bit component being at the next higher level 75% of the time.

Another approach to digital dithering adds both a random noise value and a "temporal dither" value to the error component of the M-bit signal. This improves the dithering approach described above by adding temporal dither values to avoid perceived patterns in the displayed image.

As an example, a temporal dither may be accomplished by defining a 4×4 spatial pattern block that changes on a frame-by-frame basis and repeats every 4 frames. The following table illustrates an example of such a pattern. The values A, B, C, and D represent the dither values 0.0, 0.25, 05, and 0.75, respectively. The pattern has a spatial variation to eliminate flicker. Each frame includes all four dither values, with pixel visiting all four dither values during the four frames.

| frame 0 | frame 1 | frame 2 | frame 3 |
|---|---|---|---|
| A C B D | C B D A | B D A C | D A C B |
| C D A B | D A B C | A B C D | B C D A |
| B A D C | A D C B | D C B A | C B A D |
| D B C A | B C A D | C A D B | A D B C |
| | ← | ← | ← |

The above table, where the columns are rotated as indicated by the arrows, has been experimentally determined to provide good results. The above table is easily implemented with a state machine and can be easily modified for displays that use line doubling.

Many other spatial-temporal dither patterns could be used. For example, the number of dither values, the block size and shape, the temporal frequency, and the pattern within each block are all variable.

Figure 5:
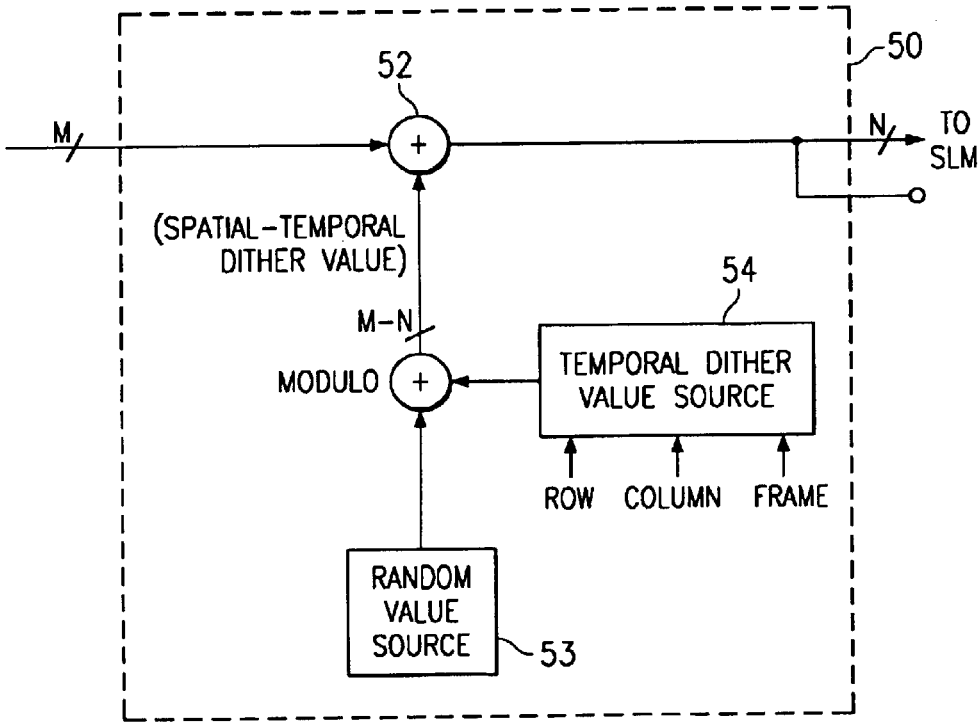
FIG. 5 illustrates an alternative embodiment of the dithering unit of FIG. 4.

FIG. 5 illustrates a spatial-temporal dithering unit 50. The M-bit video signal is fed to a summing device 52, where a spatial-temporal dither signal is added to the M-bit signal.

The spatial-temporal dither signal is the sum of a signal from random value source 53 and a temporal dither table 54. For each pixel value, source 53 provides a random value and table 54 provides a temporal dither value located in the table by a row, column, and field identifier. For example, for row 1, column 1, frame 2, the temporal dither value would be B=0.5. Source 53 may be implemented with a linear feedback shift register, such as that described above in connection with FIG. 2. Table 54 is implemented in memory. Alternatively, table 54 could be implemented as a state machine.

For each pixel, the random value and the temporal dither value are added together. It is assumed that modulo addition is used to retain the desired number of bits. The resulting M−N bit word forms a dither signal, which is added to the M-bit input signal. The sum is truncated to the N most significant bits, which results in the N-bit display signal. The dither pattern illustrated above could be used without the random value dither to reduce contouring, but the resulting image would tend to have a slight repetitive pattern. This is reduced by incorporating random values into the dither signal. The random value dither breaks up spatial patterns but does not contribute a temporal component, which can tend to result in each pixel converging to the higher resolution signal over time.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dither unit for a display system that generates images with a linear display device having a predetermined display resolution, comprising:

a random value source;

a temporal dither value source;

a first logic circuit for adding values from said random value source and said temporal dither source to provide spatial-temporal dither values;

a second logic circuit for receiving a high resolution signal representing pixel values of said images, said high resolution signal having a resolution per pixel greater than the resolution of said display device, less significant bits of said high resolution signal representing an error component of said high resolution signal, said second logic circuit adding each pixel value of said high resolution signal to said spatial-temporal dither value to provide a dithered high resolution signal; and truncation circuitry operable to truncate said dithered high resolution signal to provide a signal having the display resolution of said display.

2. The dither unit of claim 1, wherein said random value source is a shift register.

3. The dither unit of claim 2, wherein said temporal dither source is a lookup table.

4. The dither unit of claim 1, wherein said temporal dither source is a lookup table.

5. A method of generating images with a linear display device having a predetermined display resolution, comprising the steps of:

providing a random value source;

providing a temporal dither value source;

adding values from said random value source and said temporal dither source to provide spatial-temporal dither values;

receiving a high resolution signal representing pixel values of said images, said high resolution signal having a resolution per pixel greater than the resolution of said display device, less significant bits of said high resolution signal representing an error component of said high resolution signal;

adding each pixel value of said high resolution signal to said spatial-temporal dither values to provide a dithered high resolution signal; and truncating said dithered high resolution signal to provide a signal having the display resolution of said display.

6. The method of claim 5 further including the step of providing a shift register as said random value source.

7. The method of claim 6 further including the step of providing a lookup table as said temporal dither source.

8. The method of claim 5 further including the step of providing a lookup table as said temporal dither source.

* * * * *